US009640919B2

(12) United States Patent
Loveless et al.

(10) Patent No.: US 9,640,919 B2
(45) Date of Patent: May 2, 2017

(54) ELECTRIC VEHICLE SHIELDED POWER CABLE CONNECTOR

(71) Applicant: HUBER+SUHNER Inc., Charlotte, NC (US)

(72) Inventors: Richard Whitcomb Loveless, Charlotte, NC (US); Randall Foster Whitcomb, South Burlington, VT (US)

(73) Assignee: HUBER+SUHNER AG, Herisau (CH)

( * ) Notice: Subject to any disclaimer, the term of this patent is extended or adjusted under 35 U.S.C. 154(b) by 0 days.

(21) Appl. No.: 14/970,693

(22) Filed: Dec. 16, 2015

(65) Prior Publication Data

US 2016/0099527 A1 Apr. 7, 2016

Related U.S. Application Data

(63) Continuation-in-part of application No. PCT/US2014/047821, filed on Jul. 23, 2014.

(Continued)

(51) Int. Cl.

*H01R 13/6592* (2011.01)
*H01R 13/52* (2006.01)
*H01R 9/05* (2006.01)

(52) U.S. Cl.

CPC ..... *H01R 13/6592* (2013.01); *H01R 13/5205* (2013.01); *H01R 9/0524* (2013.01); *H01R 2201/26* (2013.01)

(58) Field of Classification Search

CPC ..... H01R 9/05; H01R 9/0518; H01R 9/0524; H01R 13/5202; H01R 13/5205; H01R 13/648; H01R 13/6592; H01R 2201/26

(Continued)

(56) References Cited

U.S. PATENT DOCUMENTS 4,540,231 A * 9/1985 Forney, Jr. ..... H01R 9/05 439/274
5,002,503 A * 3/1991 Campbell ..... H01R 9/053 439/578

(Continued)

FOREIGN PATENT DOCUMENTS

| | | | |
|---|---|---|---|
| CN | 102598427 | A | 7/2012 |
| WO | 2011/045328 | A2 | 4/2011 |
| WO | 2013/002396 | A1 | 1/2013 |

OTHER PUBLICATIONS

International Search Report and Written Opinion (Application No. PCT/US2014/047821) dated Nov. 21, 2014.

*Primary Examiner* — Tulsidas C Patel
*Assistant Examiner* — Travis Chambers
(74) *Attorney, Agent, or Firm* — Burr & Brown, PLLC

(57) ABSTRACT

A connector assembly mechanically and electrically connects a shielded power cable, capable of conducting DC and multiple phase AC electric power, to drive motors and powered accessories of an electric vehicle. The connector assembly includes a shielded power cable, a connector body, a sealing ring, a tapered compression ring and a flexible rubber boot. The hollow frustoconical interior of the connector body and the frustoconical tapered compression ring, with the shield layer of the power cable compressed between them, form a self-locking taper that provides a strong mechanical connection. The sealing ring and the flexible rubber boot inhibit penetration of fluids and particles into the connector assembly. The addition of an adhesive to the compressed section strengthens the connection and reduces corrosion. Filling empty spaces inside the connector body with an adhesive sealer further prevents penetration by contaminants, reduces corrosion and strengthens the connector.

8 Claims, 8 Drawing Sheets

Related U.S. Application Data

(60) Provisional application No. 61/958,388, filed on Jul. 26, 2013.

(58) Field of Classification Search
USPC ..... 439/607.01, 607.41, 583–585, 322, 578
See application file for complete search history.

(56) References Cited

U.S. PATENT DOCUMENTS

| | | | | |
|---|---|---|---|---|
| 5,468,161 | A | 11/1995 | Wright | |
| 5,777,269 | A | 7/1998 | Handley | |
| 5,817,979 | A | 10/1998 | O'Neill | |
| 7,331,820 | B2 * | 2/2008 | Burris | H01R 9/05 439/275 |
| 7,497,729 | B1 * | 3/2009 | Wei | H01R 9/0524 439/578 |
| 8,118,613 | B2 | 2/2012 | Rapp et al. | |
| 8,517,754 | B2 * | 8/2013 | Shaw | H01R 9/0524 439/275 |
| 2006/0166552 | A1 | 7/2006 | Bence et al. | |
| 2013/0337705 | A1 | 12/2013 | Kalayjian et al. | |
| 2014/0097015 | A1 | 4/2014 | Suzuki et al. | |

* cited by examiner

ELECTRIC VEHICLE SHIELDED POWER CABLE CONNECTOR

CROSS-REFERENCE TO RELATED APPLICATIONS

This application is a continuation-in-part of International Application No. PCT/US2014/047821 filed Jul. 23, 2014, and claims priority to U.S. Provisional Application Ser. No. 61/958,388, filed Jul. 26, 2013, the entireties of which are incorporated herein by reference.

FIELD OF THE INVENTION

This invention is directed generally to a connection device for a flexible power cable and, in particular, to a shielded cable connector assembly for electrically terminating, grounding, and mechanically securing a shielded cable. More specifically, the invention is directed to a device and method for providing very low electrical resistance grounding and secure mechanical connection between a termination point and a shielded power cable used to transmit power in an electric or hybrid-electric vehicle.

BACKGROUND OF THE INVENTION

As a result of the widespread development of electric powered and hybrid/electric powered vehicles, there is a need for a mechanical and electrical means for terminating shielded power transmission cables at connection points within a vehicle. Electric powered vehicles have been developed to use DC and multiple phase AC electric power systems capable of providing desired levels of electric power to wheel drive motors and powered accessories mounted on vehicles. The connectors must be capable of transmitting the continuous electric current and peak current of the cable. 200-500 amperes is typical for electric vehicle power demands. The conductive core in a shielded power cable is typically composed of stranded and twisted copper or aluminum wire having a total cross-sectional area up to approximately 100 $mm^2$. The outer conductive layer in a shielded power cable is typically a braided metal sheath. The electrical insulation layers need to be mechanically, chemically and thermally robust and stable under harsh conditions.

The connection from the braided sheath to ground in a high power shielded cable must have adequate current carrying capacity. Excessive electrical resistance in the connection will cause resistive heating. Any electric power expended in the form of heat generation due to resistive heating will reduce the efficiency of the electric system, which must be avoided in an electric powered vehicle. In addition, excessive heat generated in the connector can cause corrosion of conductors, melt insulators, deteriorate materials from which the connector is constructed, cause damage to adjacent parts and increase a risk of fire.

Another significant consideration in designing connectors used in electric vehicles is protection of electric/electronic components within the vehicle from electromagnetic interference radiating from power transmission cables. Such protection is provided around the power cable by the conductive braided sheath surrounding the conductive core. For maximum protection, the outer conductor must continue, uninterrupted, around the entire circumference of the conductive core for the entire length of the cable, including at the electrical/mechanical connection points. Gaps or inconsistencies in the outer conductor (braided sheath) at the connector will reduce the shielding capability of the connector. Since electromagnetic interference can induce soft errors in a vehicle's electronic systems, poor protection against such interference in an electric or hybrid/electric vehicle could potentially damage the electronics and computer systems controlling the vehicle and affect the safe operation of the vehicle, putting passengers and others at risk of harm.

To provide a low resistance connection between the connector body and the flexible braided sheath, contact surface area must be maximized in the connector body. Maintaining a high level of shielding against emission of electromagnetic radiation also requires the flexible braided sheath to be distributed as evenly as possible around the circumference of the connection. The surface contacts in the interior of the connector body are of high importance in a connector meeting the above requirements.

Many connectors manufactured by prior art methods (e.g., stamping) have seams that can cause gaps in RF shielding of the transmission path. In addition, the internal surfaces of many connectors made by prior art methods provide inferior quality electrical contact to the braided sheath and a higher resistance electrical path to ground. As a result, connectors of the prior art can produce excessive interference and provide inferior grounding.

In addition to electrical considerations, connectors used inside a vehicle will be subjected to vibrations and other mechanical stresses during vehicle operation. Therefore, a shielded cable connector assembly is needed that can provide sufficient power transmission for the drive motors and accessories of an electric vehicle, provide a secure mechanical connection from the cable to a termination point, protect electrical components from electromagnetic interference generated within the cable, and provide a low resistance connection to ground. The present invention addresses these deficiencies in the prior art.

SUMMARY OF THE INVENTION

According to a first aspect of the invention, there is provided a connector for an electric cable, comprising an outer connector body having a tapered interior surface, and a compression ring having a tapered exterior surface, wherein the tapered interior surface of the outer connector body and the tapered exterior surface of the compression ring form a self-locking taper that pinches and locks in place a braided sheath of a shielded electric cable.

The connector can further comprise an adhesive sealer filling at least a portion of an inner volume of the connector body to join the connector body, compression ring and braided sheath to one another. The adhesive sealer forms an environmental seal within the connector body.

Preferably, the tapered interior surface of the outer connector body and the tapered exterior surface of the compression ring are tapered at an angle of approximately 2°-8° with respect to a central longitudinal axis of the connector.

According to another aspect of the invention, there is provided a shielded cable connector assembly for an electric vehicle, comprising a cable having a conductive core, a core insulator, a braided sheath and an outer insulator, and a connector having an outer connector body having a tapered interior surface and a compression ring having a tapered exterior surface, wherein the tapered interior surface of the outer connector body and the tapered exterior surface of the compression ring form a self-locking taper that pinches and locks in place the braided sheath to secure the connector on the cable.

The shielded cable connector assembly can further comprise an adhesive sealer that covers the compression ring and the braided sheath at least in the area where the braided sheath is pinched, such that the cable and connector are mechanically fixed and a contact area between the braided sheath and the connector is protected from corrosion.

Preferably, the adhesive sealer penetrates the braided sheath between the core insulator and the outer insulator over a distance sufficient to prevent capillary flow of environmental media along the sheath through the cable.

The outer connector body can have an annular rim at a cable entry side that has an inner diameter that is smaller than an outer diameter of the outer insulator to create a first sealing point. Alternatively, the outer connector body can have an annular rim at a cable entry side that has an inner diameter that is larger than an outer diameter of the outer insulator to facilitate assembly, wherein an outer surface of the outer connector body in the vicinity of the annular rim is compressed by a crimping operation after inserting the cable to create a strain release and first sealing point.

According to another aspect of the invention, there is provided a shielded cable connector assembly for an electric vehicle, comprising: (a) a shielded cable comprising an electrically conductive core, a core insulator layer comprising a flexible tubular dielectric layer covering and in contact with the outer surface of the conductive core, a flexible sheath layer comprising braided electrically conductive wire covering and in contact with the outer surface of the core insulator, and an outer insulator layer comprising a flexible tubular dielectric layer covering and in contact with the outer surface of the flexible sheath layer; (b) a connector comprising (i) a substantially tubular body formed of electrically conductive metal, the body having a first end and a second end, an interior surface of the body defining an axially oriented frustoconical space, a sealing ring region, a sealing flange and an open region, wherein the frustoconical space extends from a first interior diameter of the interior surface at the first end of the body to a second interior diameter of the interior surface at the sealing ring region, the second interior diameter being smaller than the first interior diameter such that the interior surface defining the frustoconical space is at a first angle relative to an axis of the connector, wherein the sealing ring region is adjacent to the frustoconical space and has the second diameter, wherein the sealing flange extends from the second diameter at the sealing ring region in a direction perpendicular to the axis of the connector, to form a flange having an inner diameter smaller than the second diameter and larger than the outer diameter of the core insulator layer of the shielded cable, wherein the open region extends from the sealing flange to the second end of the body, and wherein the connector is capable of connecting to an electrical connection in the electric vehicle; (ii) a tapered compression ring comprising a first planar face and a second planar face, each of the first and second planar faces being perpendicular to an axis of the tapered compression ring, a frustoconical exterior surface extending from the first planar face to the second planar face, a diameter of the frustoconical exterior surface at the first planar face being smaller than a diameter of the frustoconical exterior surface at the second planar face, the frustoconical exterior surface being at the first angle relative to the axis of the tapered compression ring, a center hole from the first planar face to the second planar face oriented along the axis of the tapered compression ring and having a diameter larger than the outer diameter of the outer insulator layer of the flexible braided sheath, wherein the tapered compression ring is positioned internal to and axially aligned with the connector body between the first end of the body and the sealing ring region, wherein the tapered compression ring is under compression inside the connector body, and (iii) a sealing ring positioned inside and axially aligned with the connector body adjacent to the sealing flange to provide a first seal between the outer diameter of the sealing ring and the interior surface of the connector body in the sealing ring region, and comprising a center hole having an inside diameter set to provide a second seal against the exterior of the core insulator layer on a section of the shielded cable with the outer insulator layer and the flexible braided sheath layer removed; and (c) a flexible boot comprised of a substantially tubular shape with a first boot end diameter set to provide a seal around the outside surface of the first end of the connector body and a second boot end diameter set to provide a seal around the exterior surface of the outer insulator of the shielded cable, wherein the shielded cable is positioned within the connector body such that an end of the cable extends a length outside the second end of the connector body, the outer insulator layer and the flexible braided sheath layer removed from the entire extended length and the core insulator layer removed from the conductive core for a portion of the extended length, the portion including the end of the conductive core, wherein the outer insulator layer is further removed from the cable internal to the connector body to a point proximate to the first end of the connector body, wherein the shielded cable having the outer insulator layer removed, extends through the center hole of the tapered compression ring, wherein a section of the flexible braided sheath layer is separated from the core insulator between the first planar face and the cable end, flared radially outward from the cable and evenly distributed over the first planar face and the frustoconical outer surface of the tapered compression ring to the second planar face, and wherein a portion of the flared flexible braided sheath layer spread over the frustoconical outer surface is pressed between the frustoconical outer surface of the tapered compression ring and the interior surface of the frustoconical space of the connector body.

In some embodiments, the connector body provides a low resistance electrical connection between the flexible braided sheath and the connector body. In some embodiments, the low resistance electrical connection has a resistance of less than 2 milliohms. In some embodiments, the shielded cable and connector assembly is capable of conducting high levels of continuous power in the range of from about 200 amperes to about 500 amperes and higher. In some embodiments, the electromagnetic interference emitted at the connector assembly is no greater than the interference emitted by the shielded cable.

In some embodiments, an adhesive provided in a least a portion of the interstitial areas where the flexible braided sheath layer is pressed between the interior surface of the frustoconical space of the connector body and the frustoconical outer surface of the tapered compression ring. In some embodiments, the adhesive comprises an epoxy resin. In some embodiments, the adhesive provides protection against galvanic corrosion of the connector assembly.

In some embodiments, an adhesive sealer is provided in at least a portion of the frustoconical space inside the connector body. In some embodiments, the adhesive sealer comprises a bonding filler, epoxy resin or silicon resin. In some embodiments, the adhesive sealer resists penetration of fluids and particles into the frustoconical space in the connector body. In some embodiments, the adhesive sealer provides protection against galvanic corrosion of the connector assembly. In some embodiments, the adhesive sealer increases the reliability of the connector assembly by eliminating electrical shorts caused by vibrational flexing and breakage of the flexible braided sheath.

In some embodiments, the tapered compression ring and the connector body are mechanically connected by a self-locking taper. In some embodiments, the first angle is between 2 degrees and 8 degrees.

In some embodiments, the connector body further comprises a mounting feature for mechanically and electrically for connecting the connector body to a termination point.

In some embodiments, the sealing ring resists penetration of fluids into the frustoconical space in the connector body at the sealing ring region.

In some embodiments, the connector body includes an exterior surface ridge around the perimeter at the connector body first end and the flexible boot includes an interior lip at the flexible boot first end, such that the interior lip and the exterior ridge engage to inhibit the flexible boot slipping off the connector body.

According to another aspect of the invention, there is provided a shielded cable connector assembly, comprising: (a) a shielded cable comprising an electrically conductive core, a core insulator layer comprising a flexible tubular dielectric layer covering and in contact with the outer surface of the conductive core, a flexible sheath layer comprising braided electrically conductive wire covering and in contact with the outer surface of the core insulator, and an outer insulator layer comprising a flexible tubular dielectric layer covering and in contact with the outer surface of the flexible sheath layer; (b) a connector comprising (i) a substantially tubular body formed of electrically conductive metal, the body having a first end and a second end, an interior surface of the body defining an axially oriented frustoconical space, a sealing ring region, a sealing flange and an open region, wherein the frustoconical space extends from a first interior diameter of the interior surface at the first end of the body to a second interior diameter of the interior surface at the sealing ring region, the second interior diameter being smaller than the first interior diameter such that the interior surface defining the frustoconical space is at a first angle relative to an axis of the connector, wherein the sealing ring region is adjacent to the frustoconical space and has the second diameter, wherein the sealing flange extends from the second diameter at the sealing ring region in a direction perpendicular to the axis of the connector, to form a flange having an inner diameter smaller than the second diameter and larger than the outer diameter of the core insulator layer of the shielded cable, and wherein the open region extends from the sealing flange to the second end of the body; (ii) a tapered compression ring comprising a first planar face and a second planar face, each of the first and second planar faces being perpendicular to an axis of the tapered compression ring, a frustoconical exterior surface extending from the first planar face to the second planar face, a diameter of the frustoconical exterior surface at the first planar face being smaller than a diameter of the frustoconical exterior surface at the second planar face, the frustoconical exterior surface being at the first angle relative to the axis of the tapered compression ring, a center hole from the first planar face to the second planar face oriented along the axis of the tapered compression ring and having a diameter larger than the outer diameter of the outer insulator layer of the flexible braided sheath, wherein the tapered compression ring is positioned internal to and axially aligned with the connector body between the first end of the body and the sealing ring region, wherein the tapered compression ring is under compression inside the connector body, and (iii) a sealing ring positioned inside and axially aligned with the connector body adjacent to the sealing flange to provide a first seal between the outer diameter of the sealing ring and the interior surface of the connector body in the sealing ring region, and comprising a center hole having an inside diameter set to provide a second seal against the exterior of the core insulator layer on a section of the shielded cable with the outer insulator layer and the flexible braided sheath layer removed; and (c) a flexible boot comprised of a substantially tubular shape with a first boot end diameter set to provide a seal around the outside surface of the first end of the connector body and a second boot end diameter set to provide a seal around the exterior surface of the outer insulator of the shielded cable, wherein the shielded cable is positioned within the connector body such that an end of the cable extends a length outside the second end of the connector body, the outer insulator layer and the flexible braided sheath layer removed from the entire extended length and the core insulator layer removed from the conductive core for a portion of the extended length, the portion including the end of the conductive core, wherein the outer insulator layer is further removed from the cable internal to the connector body to a point proximate to the first end of the connector body, wherein the shielded cable having the outer insulator layer removed, extends through the center hole of the tapered compression ring, wherein a section of the flexible braided sheath layer is separated from the core insulator between the first planar face and the cable end, flared radially outward from the cable and evenly distributed over the first planar face and the frustoconical outer surface of the tapered compression ring to the second planar face, and wherein a portion of the flared flexible braided sheath layer spread over the frustoconical outer surface is pressed between the frustoconical outer surface of the tapered compression ring and the interior surface of the frustoconical space of the connector body.

According to another aspect of the invention, there is provided a shielded cable connector assembly, comprising: (a) a shielded cable comprising an electrically conductive core, a core insulator layer comprising a flexible tubular dielectric layer covering and in contact with the outer surface of the conductive core, a flexible sheath layer comprising braided electrically conductive wire covering and in contact with the outer surface of the core insulator, and an outer insulator layer comprising a flexible tubular dielectric layer covering and in contact with the outer surface of the flexible sheath layer; (b) a connector comprising (i) a substantially tubular body formed of electrically conductive metal, the body having a first end and a second end, an interior surface of the body defining an axially oriented frustoconical space, a sealing ring region, a sealing flange and an open region, wherein the frustoconical space extends from a first interior diameter of the interior surface at the first end of the body to a second interior diameter of the interior surface at the sealing ring region, the second interior diameter being smaller than the first interior diameter such that the interior surface defining the frustoconical space is at a first angle relative to an axis of the connector, wherein the sealing ring region is adjacent to the frustoconical space and has the second diameter, wherein the sealing flange extends from the second diameter at the sealing ring region in a direction perpendicular to the axis of the connector, to form a flange having an inner diameter smaller than the second diameter and larger than the outer diameter of the core insulator layer of the shielded cable, and wherein the open region extends from the sealing flange to the second end of the body; (ii) a tapered compression ring comprising a first planar face and a second planar face, each of the first and second planar faces being perpendicular to an axis of the tapered compression ring, a frustoconical exterior surface extending from the first planar face to the second planar face, a diameter of the frustoconical exterior surface at the first planar face being smaller than a diameter of the frustoconical exterior surface at the second planar face, the frustoconical exterior surface being at the first angle relative to the axis of the tapered compression ring, a center hole from the first planar face to the second planar face oriented along the axis of the tapered compression ring and having a diameter larger than the outer diameter of the outer insulator layer of the flexible braided sheath, wherein the tapered compression ring is positioned internal to and axially aligned with the connector body between the first end of the body and the sealing ring region, wherein the tapered compression ring is under compression inside the connector body, and (iii) a sealing ring positioned inside and axially aligned with the connector body adjacent to the sealing flange to provide a first seal between the outer diameter of the sealing ring and the interior surface of the connector body in the sealing ring region, and comprising a center hole having an inside diameter set to provide a second seal against the exterior of the core insulator layer on a section of the shielded cable with the outer insulator layer and the flexible braided sheath layer removed; and wherein the shielded cable is positioned within the connector body such that an end of the cable extends a length outside the second end of the connector body, the outer insulator layer and the flexible braided sheath layer removed from the entire extended length and the core insulator layer removed from the conductive core for a portion of the extended length, the portion including the end of the conductive core, wherein the outer insulator layer is further removed from the cable internal to the connector body to a point proximate to the first end of the connector body, wherein the shielded cable having the outer insulator layer removed, extends through the center hole of the tapered compression ring, wherein a section of the flexible braided sheath layer is separated from the core insulator between the first planar face and the cable end, flared radially outward from the cable and evenly distributed over the first planar face and the frustoconical outer surface of the tapered compression ring to the second planar face, and wherein a portion of the flared flexible braided sheath layer spread over the frustoconical outer surface is pressed between the frustoconical outer surface of the tapered compression ring and the interior surface of the frustoconical space of the connector body.

BRIEF DESCRIPTION OF THE DRAWINGS

For a fuller understanding of the nature and objects of the invention, reference should be made to the following detailed description of a preferred mode of practicing the invention, read in connection with the accompanying drawings in which.

DETAILED DESCRIPTION OF THE INVENTION

Figure 1:
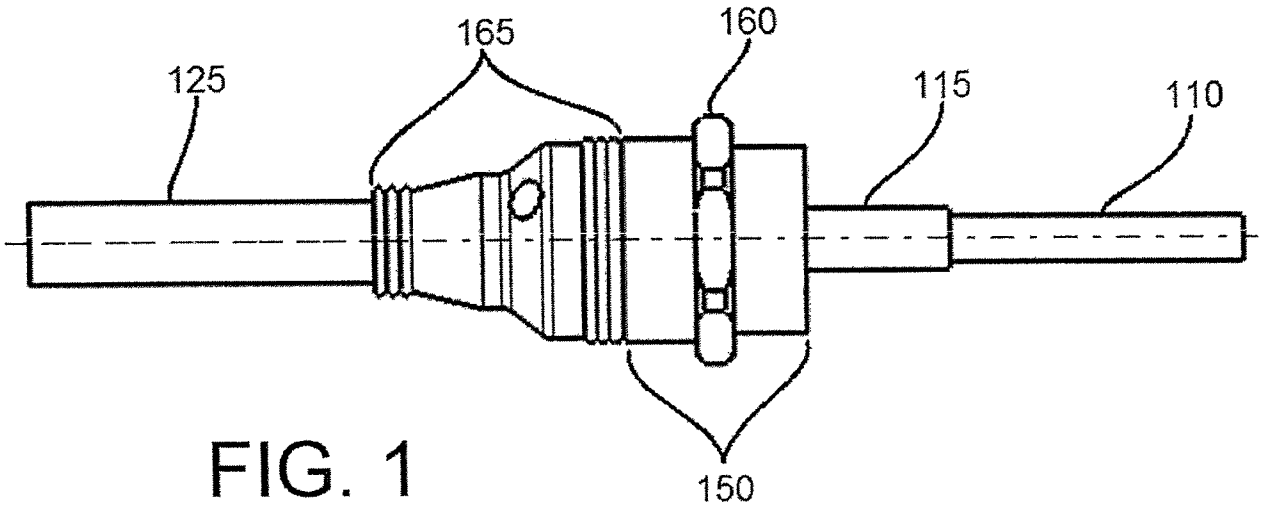
FIG. 1 is an illustration of a first embodiment of the present invention in the form of a connector attached to a shielded cable.

FIG. 1 illustrates a shielded cable having a connection end prepared for connection to a termination point and a first embodiment of the connector of the present invention assembled therewith. Connector body 150 includes mounting feature 160 for mechanically attaching the connection end of the connector to a termination point. The connector in FIG. 1 further comprises flexible boot 165 positioned over a cable end of connector body 150.

Flexible boot 165 extends from the cable end of connector body 150 onto the shielded cable outer insulator 125. The flexible boot 165 includes constrictive ridges on both ends to provide an environmental seal to the external surfaces of the cable end of connector body 150 and the outer insulator 125. The exterior of flexible boot 165 tapers from a diameter large enough to snugly fit over the cable end of connector body 150 to a smaller diameter providing a seal around the outer insulator 125. Flexible boot 165 is optionally but preferably provided to prevent fluid and particulate contaminants from penetrating into the connector from the cable end. Contaminants that enter a connector can penetrate the electrical termination point to which the connector is connected. Additionally, fluid contaminants may seep into the interstitial spaces between the wires of the braided sheath on one end of the power cable, travel the entire length of the cable and eventually contaminate the connection on the other end of the cable.

Flexible boot 165 is comprised of a flexible, elastic material. Preferably, the elastic material will be resistant to high temperature. Typically, the elastic material is rubber. In an exemplary embodiment, the elastic material is silicone rubber.

From the connection end of the connector body 150 in FIG. 1, an end section of conductive core 110 extends with the other layers removed so the conductive core may be connected to a termination point. Starting from a short distance outside the connection end the connector body 150 and continuing through the connector, the conductive core 110 is covered by core insulator 115 to avoid an electrical short between conductive core 110 and connector body 150.

Figure 2:
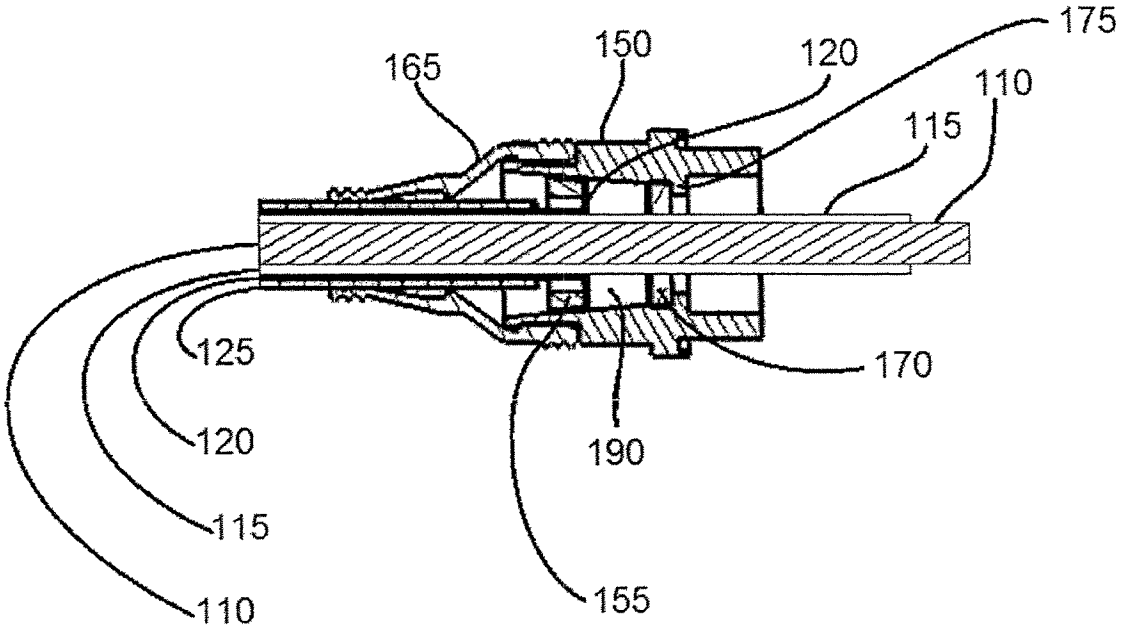
FIG. 2 is an illustration of a cross-sectional view of the first embodiment of the present invention.

FIG. 2 illustrates a cross-sectional view of the shielded connector and shielded cable of FIG. 1 from the perspective of a vertical plane through the approximately aligned axes of the hollow center of connector body 150 and the shielded cable positioned therein. FIG. 2 illustrates that a shielded cable comprises, in concentric layers proceeding outwardly from the center, conductive core 110, core insulator 115, sheath 120 and outer insulator 125. Based on the desired length of the bare conductor 110 needed at the connection end, the portion of conductive core 110 that remains protected by core insulator 115 and the length of the connector body 150 itself, a section of outer insulator 125 has been removed from the end of the shielded cable. As shown in the illustration of the cable connector assembly in FIG. 2, the outer insulator 125 is typically terminated inside the cable end of the connector body 150.

The hollow interior of connector body 150 includes a conical section that tapers, at a low angle to the axis of the connector, from a larger inner diameter at the cable end of the connector body to a smaller inner diameter section, an interior sealing flange 175 and a connection end interior. The interior sealing flange 175 has a cable side and a connection side. The smaller inner diameter section is adjacent to the cable side of interior sealing flange 175. The interior diameter of sealing flange 175 is smaller than the smaller inner diameter section of the hollow interior of the connector body 150 and larger than the exterior diameter of core insulator 115. The connection end interior is on the connection side of the sealing flange 175. The dimensions and shape of the connection end interior depends on the particular embodiment of the connector needed for the mechanical interface to an electrical termination point. In an exemplary embodiment, the connection end of connector body 150 has mounting features which are optimized to suit specific application requirements (e.g. threaded, flange mounted, or other mechanical coupling types).

To seal the interior of the connector from the environment on the connection end, sealing ring 170 is installed in the smaller inner diameter section against the cable side of sealing flange 175. The diameter of a hole through the center of sealing ring 170 is set to provide a snug fit to the exterior of core insulator 115 in the connector assembly. Installing the sealing ring 170 is done in two steps. Initially, with the diameter of a hole through the center of sealing ring 170 sufficiently sized, the sealing ring 170 is easily slipped over the exposed outer surface of core insulator 115. As a second step, the sealing ring 170 is compressed into its installed position in the smaller inner diameter area of the hollow interior of the connector body 150 against the cable side of sealing flange 175. Sealing ring 170 is made of a compliant material such as PTFE, or another well-known material suitable for this purpose. The outside diameter of sealing ring 170 is compressed as it is pressed along the interior conical surface of connector body 150 and into position against sealing flange 175. As the outside diameter of sealing ring 170 is compressed, its inner diameter reduces in size such that its inner diameter provides a seal against the outer surface of core insulator 115. Thus, contaminants, such as water, cannot easily penetrate the frustoconical space of the connector interior from the connection end.

The tapered compression ring 155 has a frustoconical exterior surface and a hollow cylindrical core that are axially aligned. The frustoconical exterior surface of the tapered compression ring tapers, at a low angle to the axis of the compression ring 155, between a larger outer diameter at a first planar face and a smaller outer diameter at a second planar face, the planar faces being approximately parallel to each other and perpendicular to the axis of the tapered compression ring.

When assembling the connector on an end of a shielded cable, the desired section of the outer insulator 125 is removed, as shown in FIG. 2. First, the flexible boot 165 is slipped over the cable end and pushed past the end of outer insulator 125. Next, tapered compression ring 155 is slipped over the cable end, oriented such that the smaller planar face faces the connection end of the cable, and positioned over sheath 120, adjacent to the terminus of the outer insulator 125 where sheath 120 remains exposed.

Due to the flexibility of the braided wires in sheath 120, the exposed, terminated end of sheath 120 may be peeled away from core insulator 115, folded across the smaller planar face of tapered compression ring 155 and distributed evenly around the tapered exterior surface of tapered compression ring 155.

The low angle at which the exterior surface of the tapered compression ring tapers is set is about the same low angle at which the hollow conical interior section of connector body 150 tapers. The tapered compression ring is formed of metal or other material and sized such that it can be compressed to a range of outer diameters (from the diameter at the smaller planar face to the diameter at the larger planar face) that is entirely within the range from the smaller inner diameter to the larger inner diameter of the hollow conical interior section of the connector body 150.

The connector body 150 is situated over the shielded cable, as shown in FIG. 2, such that outer insulator 125 terminates just inside the cable end of the connector body 150. When the conical interior section of connector body 150 is axially aligned with the tapered compression ring 155 (over which the braided sheath is evenly distributed), the tapered compression ring 155 is forced into the hollow conical interior section of the connector body 150, thereby compressing the tapered compression ring 155 into a position within the hollow conical interior section such that the flexible braided sheath 120, which is distributed around the exterior frustoconical surface of the tapered compression ring, is compressed between the tapered compression ring and the conical interior surface of the connector body. A mechanical connection is created, known as a self-locking taper, by the respective low angled surfaces of the tapered compression ring 155 exterior and the connector body 150 hollow conical interior with the braided sheath 120 compressed therebetween. The low angles of the self-locking tapered surfaces may be in the range of from approximately 2 degrees to approximately 8 degrees, with a preferred low angle being approximately 5 degrees.

Figure 3:
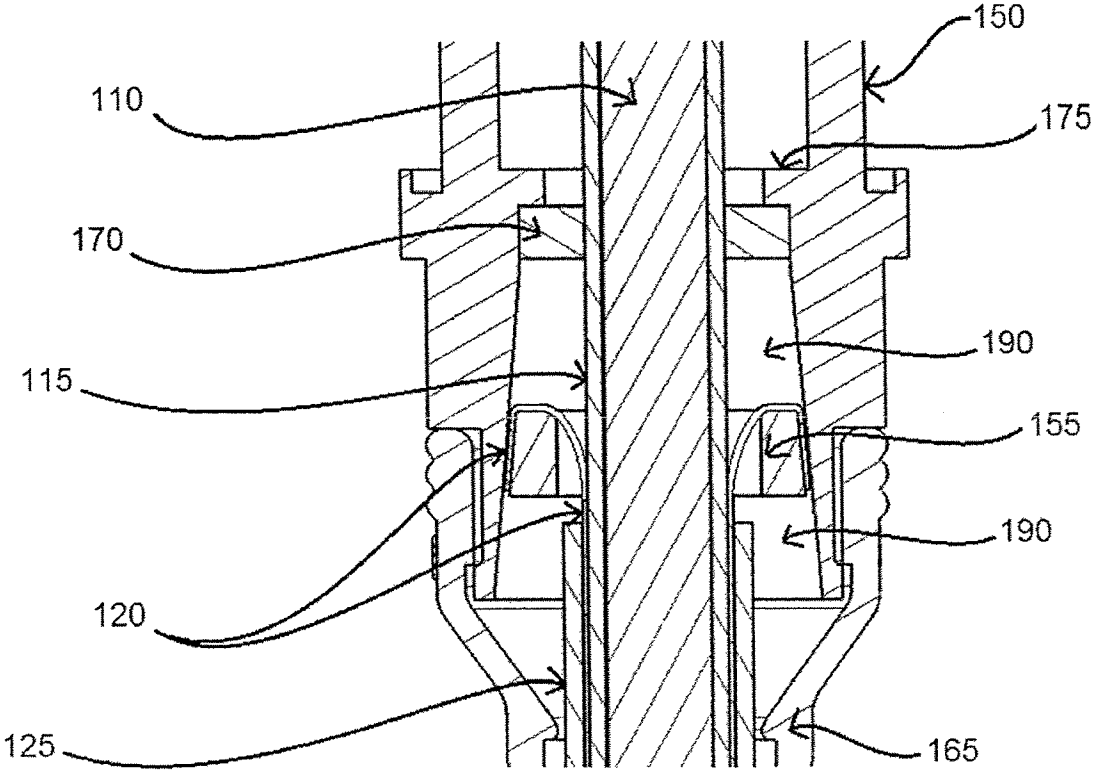
FIG. 3 is an illustration of a detailed view of the cross-sectional view of the first embodiment of the present invention.

The diameter of the hollow cylindrical core of the tapered compression ring is set so that, when in a compressed position in the connector assembly, a gap exists between the inner surface of the cylindrical core and the entire circumference of the exterior of core insulator 115, with the gap being partially occupied by the flexible braided sheath (see FIG. 3).

The cable end of connector body 150 is sealed from the environment when flexible boot 165 is positioned on the cable end of the connector body 150, as shown in FIG. 2.

Features of the connection between the connector and the shielded cable are illustrated in more detail in FIG. 3. In a fully assembled connector according to the first embodiment, cavity 190 comprises the combined unoccupied spaces within the hollow interior of connector body 150 including: space between sealing ring 170 and the smaller planar face of the compression ring 155; the gap between the cylindrical core of the compression ring 155 and the exterior surface of core insulator 115, including the interstitial spaces among the braided shield wires of the braided sheath 120, from the smaller planar face to the larger planar face of the tapered compression ring; and space between the larger planar face of compression ring 155 and the cable end of connector body 150.

As previously indicated, to protect the electrical connection and the exposed sheath 120 from environmental contaminants, the flexible boot 165 is positioned over the cable end of connector body 150 and also over outer insulator 125 to seal the connector body 150 on the cable end. Previously installed sealing ring 170, having been inserted in the interior of connector body 150 against the sealing flange provided on the interior at the smaller inner diameter end of the hollow conical interior, provides an environmental seal from contaminants on the connection end of connector body 150.

Figure 4:
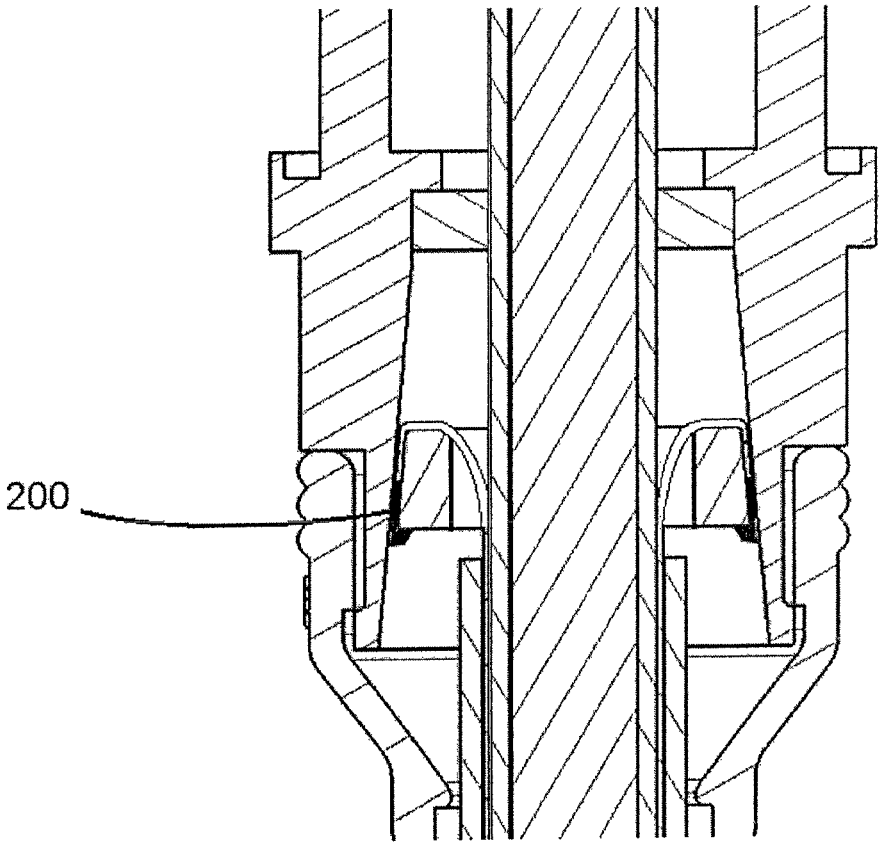
FIG. 4 is an illustration of a second embodiment of the present invention.

In an illustration of a second embodiment of the present invention, FIG. 4 shows that an adhesive 200 may be provided where the flexible braided shield sheath 120 is compressed between the tapered compression ring 155 and the hollow interior surface of the connector body 150. This embodiment of the present invention increases the mechanical strength (i.e., ruggedizes) of the connector assembly created by the self-locking tapered surfaces of the connector body 150 and tapered compression ring 155. The adhesive 200 used in this embodiment may be an epoxy or other strong securing medium. In an exemplary embodiment, the adhesive 200 is capable of exposure to high heat when set and is of a low viscosity when applied such that there is capillary penetration to fill, partially or completely, the interstitial spaces between the braided shield wires of sheath 120 in the region where they are compressed. The adhesive 200 may be provided to some or all of the compressed area of sheath 120.

Figure 5:
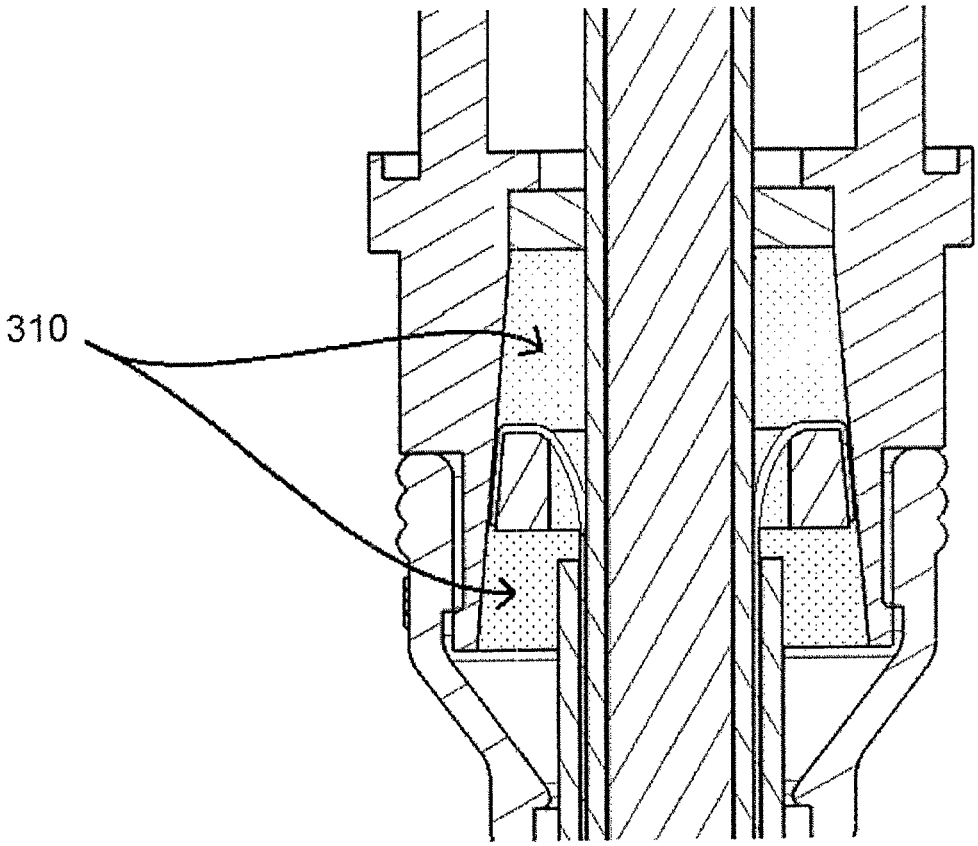
FIG. 5 is an illustration of a third embodiment of the present invention.

FIG. 5 provides an illustration of a third embodiment of the present invention, in which cavity 190 is filled with an adhesive sealer 310. The cavity 190 may be filled partially or completely with the adhesive sealer 310, before flexible boot 165 is positioned over the cable end of connector body 150, from the open cable end of the connector. Like the adhesive 200 in the second embodiment, the adhesive sealer 310 is of a low viscosity when applied such that there is capillary penetration to into the interstitial spaces between and through the braided shield wires of sheath 120, allowing the adhesive sealer 310 to penetrate throughout cavity 190. The adhesive sealer 310 is capable of exposure to high heat when set. In addition to increasing the mechanical strength of the connector assembly, like the embodiment disclosed in FIG. 4, the embodiment including the adhesive sealer 310 provides greater protection of the connection and the flexible braided shield from the environment than can be provided by the first embodiment, which relies on the flexible boot 165 and sealing ring 170 alone.

A benefit of the adhesive 200 applied to the braided sheath 120, in FIG. 4, is protection against galvanic corrosion due to the electrochemical potential between the dissimilar metals of the braided sheath and the connector body. With the addition of the adhesive 200, it can be seen that the critical junction between the cable shield 120 and the connector body is encapsulated in a protective resin in embodiment 3. This prevents any corrosion that can be precipitated by the presence of dissimilar metals in contact with one another. In an embodiment that includes both the adhesive 200 of FIG. 4 and the adhesive sealer 310 of FIG. 5, the adhesive sealer 310 further protects the metals at the junction from harsh environmental conditions that would promote corrosion.

A further benefit that the sealing adhesive 310 provides is an improvement over prior art connectors in which shield wires harden from vibration, break free, and can then migrate to some point where a short circuit can occur. The sealing adhesive 310 hermetically isolates shield wires from vibrational flexing that leads to hardening and cracking of shield wires and it encapsulates the wires such that they cannot be freed to migrate.

The increased seal against water penetration provided by the third embodiment can easily withstand high pressure spray with hot water at 1200 psi and 150 degrees C. to the outside surfaces of outer insulator 125, flexible boot 165, and connector body 150.

The proper addition of adhesive sealer 310 described by the third embodiment ensures the cable retention force of the connector will exceed the tensile strength of the braided cable shield.

Figure 6:
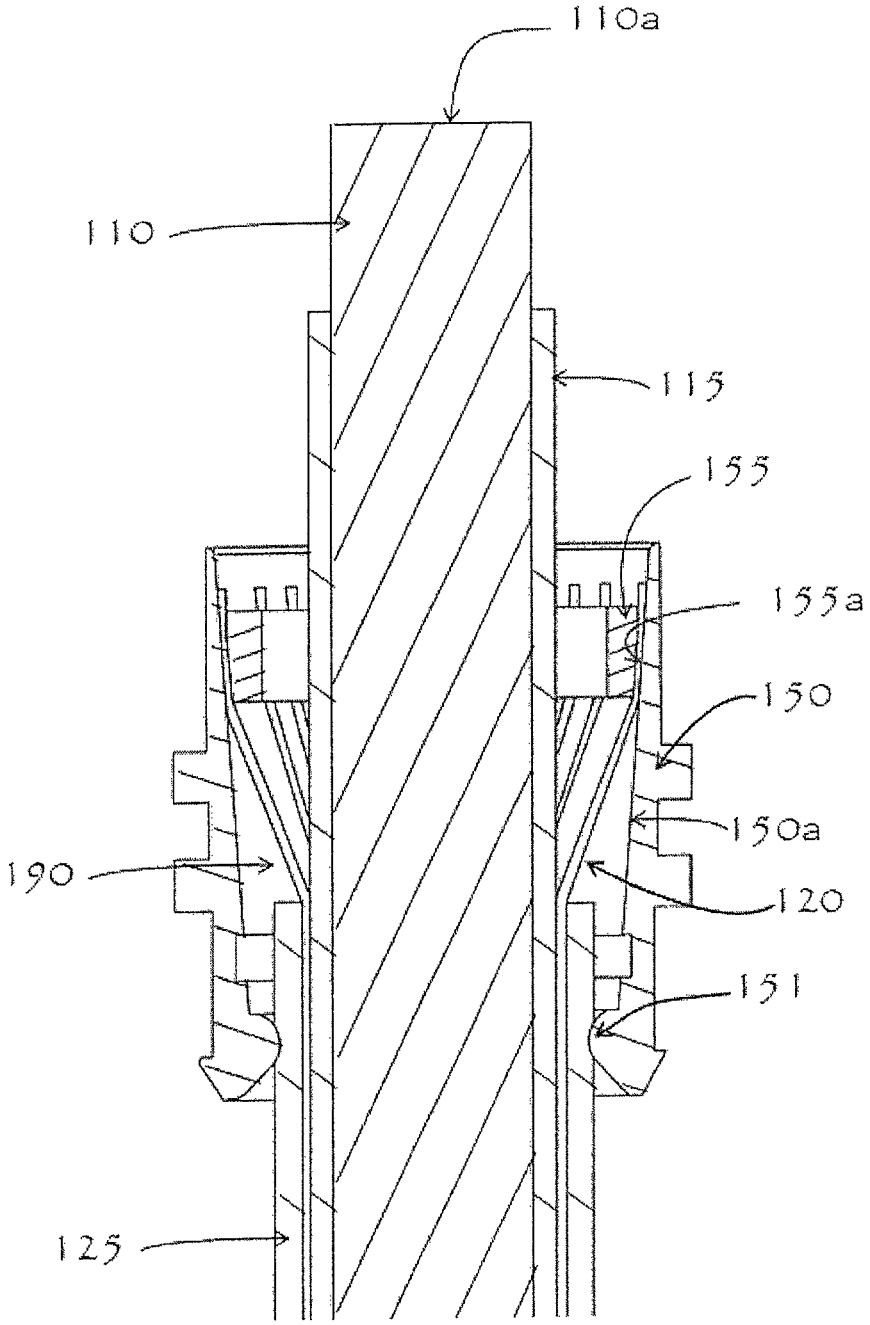
FIG. 6 is an illustration of another embodiment of the present invention.

FIG. 6 shows another embodiment of the present invention wherein like reference numerals are used to designate like parts from the prior embodiments. The connector shown in FIG. 6 is very similar to the connector shown in FIG. 3 except the orientation of the tapered surfaces has been rotated 180 degrees. More specifically, the tapered interior surface 150*a* of the connector body 150 and the tapered exterior surface 155*a* of the tapered compression ring 155 are tapered outwardly towards the terminal end 110*a* of the cable 110. In this manner, if there is an extraction force exerted on the cable (in the downward direction in FIG. 6), that force will only amplify the locking connection provided by the tapered interior surface 150*a* of the connector body 150 and the tapered exterior surface 155*a* of the tapered compression ring. In this manner, if an excessive extraction force is exerted on the cable, the connector assembly will stay intact.

Other than the differences explained above, the embodiment shown in FIG. 6 also includes an annular rim 151 that is sized at a diameter slightly less than the outer diameter of the outer insulator 125 in order to create a first sealing point against environmental media (e.g., water).

It is also possible for the annular rim 151 to have an inner diameter that is larger than an outer diameter of the outer insulator 125 to facilitate assembly of the connector on an end of the cable, after which an outer surface of the outer connector body 150 in the vicinity of the annular rim 151 is compressed by a crimping operation to create a strain release and first sealing point.

The terminal end of the braided sheath 120 is pinched between the connector body 150 and the tapered compression ring 155 without requiring the braided sheath to be curled around the tapered compression ring 155, as is the case in the embodiment depicted in FIG. 3. Allowing the braided sheath 120 to extend axially in alignment with the conductive core 110 provides improved electrical performance.

Figure 7:
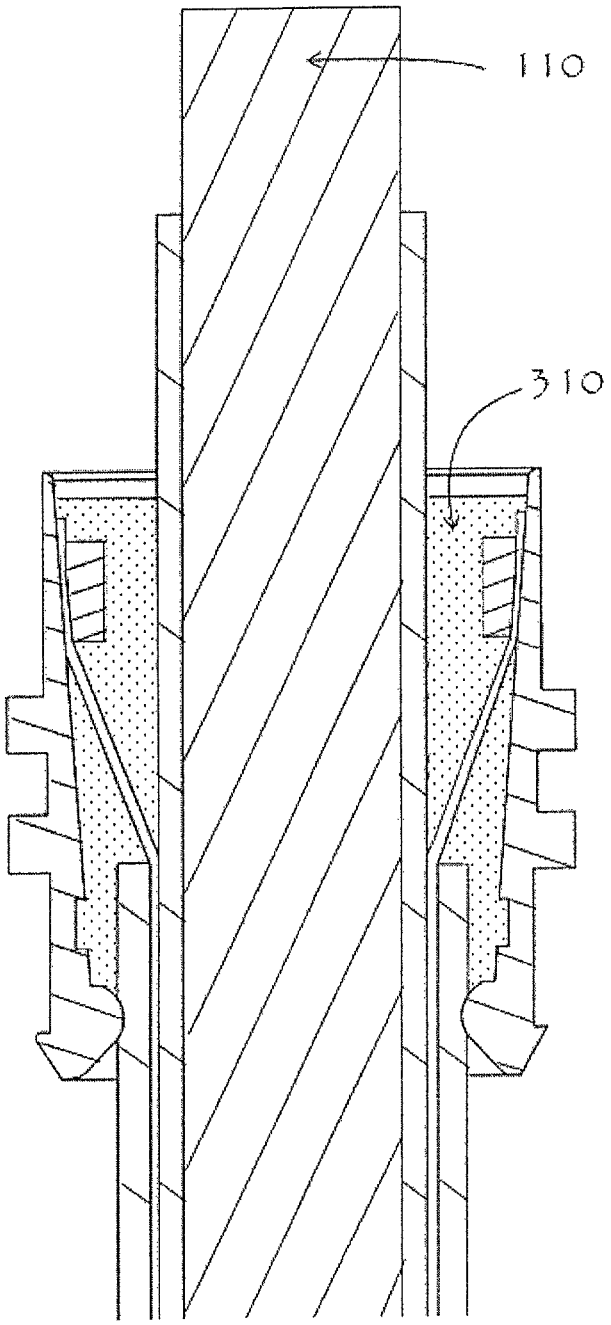
FIG. 7 shows the assembly of FIG. 6 including an adhesive sealer.

FIG. 7 shows that essentially the entire inner cavity 190 inside the connector body 150 can be filled with an adhesive sealer 310 (e.g., an epoxy). It is sufficient, however, if the adhesive sealer covers the compression ring 155 and the braided sheath 120 at least in the area where the braided sheath is pinched, as that should ensure that the cable and connector are mechanically fixed and a contact area between the braided sheath and the connector is protected from corrosion. At the very least, the adhesive sealer 310 needs to penetrate the braided sheath 120 between the core insulator 115 and the outer insulator 125 over a distance sufficient to prevent capillary flow of environmental media along the sheath 120 through the cable. This prevents such media from infiltrating inside the connector body and contacting the exposed conductive core 110.

Figure 8:
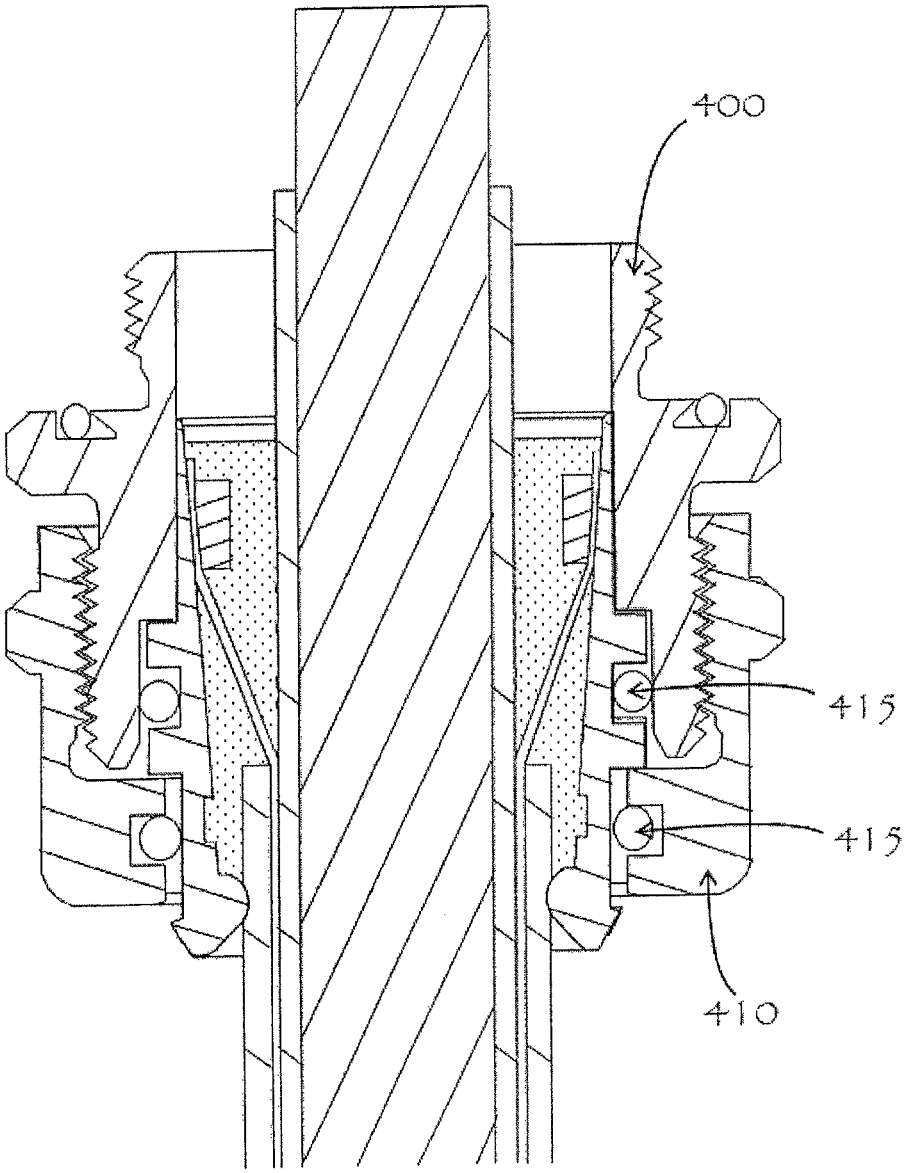
FIG. 8 shows the assembly of FIG. 6 with a panel mount and coupling nut.

FIG. 8 shows the connector of FIG. 7 as it would typically be used with a standard panel mount 400 and coupling nut 410. O-ring seals 415 can also be employed in a known fashion.

Connectors manufactured by this method are characterized by the strength of solid metal housings and features created by precision machining. The securing forces of self-locking tapered surfaces, which act to retain the cable shield, are directly controlled by the precision of the machining and the high level of assembly forces that the materials afford. The higher impact strength of the connector bodies are attributable to the characteristics of metals, such as aluminum, when compared to the molded plastics used for much of the prior art. It is not required that tapered compression ring 155 be made of an electrically conductive material.

It is recognized that a high precision turning process can easily create surfaces that provide the self-locking taper used to secure sheath 120. However, other forming methods such as casting, metal injection molding, stamping, progressive tooling, and deep drawing can also create these types of desired surfaces in electrically conductive materials.

The low resistance of the connection between the braided shield of the cable and the connector body is an essential trait of this device. In embodiments of the present invention, a resistance of 2 milliohms or less can be measured through the connector with a 40 ampere load passing along the braided cable shield and into the connector body. As used herein, the term "low resistance" indicates an electrical resistance of less than 10 milliohms, depending on tightness between the cable shield wires.

Embodiments of the connector assembly described herein provide the features of high power capability, low electrical resistance, low levels of emitted electromagnetic interference, mechanical strength and protection from environmental contaminants that are needed in connectors on power cables in electric and hybrid-electric vehicles.

As used herein, the terms "electric vehicle" and "hybrid-electric vehicle" include vehicles capable of transporting human and non-human loads using an electrically powered drive system.

As used herein, the term "evenly distributed" with regard to the flexible braided sheath layer indicates substantially uniform separation of the respective wires from which the braided sheath layer is composed.

While the present invention has been particularly shown and described with reference to the preferred mode as illustrated in the drawings, it will be understood by one skilled in the art that various changes in detail may be effected therein without departing from the spirit and scope of the invention as defined by the claims.

LIST OF REFERENCE NUMERALS

110 conductive core
110*a* terminal end of 110
115 core insulator
120 braided sheath
125 outer insulator
150 connector body
150*a* tapered interior surface of 150
151 annular rim
155 tapered compression ring
155*a* tapered exterior surface of 155
160 mounting feature
165 flexible boot
170 sealing ring
175 sealing flange
190 cavity
200 adhesive
310 adhesive sealer
400 panel mount
410 coupling ring
415 o-ring seals

What is claimed:

1. A connector for an electric cable, comprising:

an outer connector body having a tapered interior surface; and a compression ring having a tapered exterior surface;

wherein the tapered interior surface of the outer connector body and the tapered exterior surface of the compression ring form a self-locking taper that pinches and locks in place a braided sheath of a shielded electric cable.

2. The connector according to claim 1, wherein the tapered interior surface of the outer connector body and the tapered exterior surface of the compression ring are tapered at an angle of approximately 2°-8° with respect to a central longitudinal axis of the connector.

3. The connector of claim 1, further comprising an adhesive sealer filling at least a portion of an inner volume of the connector body to join the connector body, compression ring and braided sheath to one another.

4. The connector body according to claim 3, wherein the adhesive sealer forms an environmental seal within the connector body.

5. A shielded cable connector assembly for an electric vehicle, comprising:

a cable having a conductive core, a core insulator, a braided sheath and an outer insulator;

a connector having an outer connector body having a tapered interior surface and a compression ring having a tapered exterior surface, wherein the tapered interior surface of the outer connector body and the tapered exterior surface of the compression ring form a self-locking taper that secures and locks in place the braided sheath to secure the connector on the cable; and an adhesive sealer that covers the compression ring and the braided sheath at least in the area where the braided sheath is secured, such that the cable and connector are mechanically fixed and a contact area between the braided sheath and the connector is protected from corrosion, wherein the adhesive sealer penetrates the braided sheath between the core insulator and the outer insulator over a distance sufficient to prevent capillary flow of environmental media along the sheath through the cable.

6. The shielded cable connector assembly according to claim 5, wherein the tapered interior surface of the outer connector body and the tapered exterior surface of the compression ring are tapered at an angle of approximately 2°-8° with respect to a central longitudinal axis of the connector.

7. A shielded cable connector assembly for an electric vehicle, comprising:

a cable having a conductive core, a core insulator, a braided sheath and an outer insulator; and a connector having an outer connector body having a tapered interior surface and a compression ring having a tapered exterior surface, wherein the tapered interior surface of the outer connector body and the tapered exterior surface of the compression ring form a self-locking taper that secures and locks in place the braided sheath to secure the connector on the cable, wherein the outer connector body has an annular rim at a cable entry side that has an inner diameter that is smaller than an outer diameter of the outer insulator to create a first sealing point.

8. A shielded cable connector assembly for an electric vehicle, comprising:

a cable having a conductive core, a core insulator, a braided sheath and an outer insulator; and a connector having an outer connector body having a tapered interior surface and a compression ring having a tapered exterior surface, wherein the tapered interior surface of the outer connector body and the tapered exterior surface of the compression ring form a self-locking taper that secures and locks in place the braided sheath to secure the connector on the cable, wherein the outer connector body has an annular rim at a cable entry side that has an inner diameter that is larger than an outer diameter of the outer insulator to facilitate assembly, wherein an outer surface of the outer connector body in the vicinity of the annular rim is compressed by a crimping operation after inserting the cable to create a strain release and first sealing point.

* * * * *